US006302796B1

(12) United States Patent
Lebensfeld et al.

(10) Patent No.: US 6,302,796 B1
(45) **Date of Patent: *Oct. 16, 2001**

(54) PLAYER PROGRAMMABLE, INTERACTIVE TOY FOR A SHOOTING GAME

(75) Inventors: Steven Lebensfeld, Laurel Hollow, NY (US); David Chu Ki Kwan, Hong Kong (HK); Frank Landi, Great Neck; Carmine Russo, West Islip, both of NY (US); John Ping Chan, Bridgewater, NJ (US)

(73) Assignee: Toymax Inc., Plainview, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/015,863

(22) Filed: Jan. 29, 1998

Related U.S. Application Data

(63) Continuation-in-part of application No. 08/871,248, filed on Jun. 9, 1997, now Pat. No. 5,984,262, and a continuation-in-part of application No. 08/795,895, filed on Feb. 5, 1997, now Pat. No. 5,741,185.

(51) Int. Cl.[7] ..... A63F 9/24

(52) U.S. Cl. ..... 463/51; 463/53; 446/175

(58) Field of Search ..... 463/1–2, 49–53, 463/56, 30–31, 36, 39; 446/175, 397, 401, 404–406, 436–437, 441–443, 465, 473; 434/20–22, 24, 307 R; 700/91–92

(56) References Cited

U.S. PATENT DOCUMENTS

| | | | |
|---|---|---|---|
| 2,119,005 | | 5/1938 | Carter . |
| 2,404,653 | | 7/1946 | Plebanek . |
| 2,957,693 | | 10/1960 | Ross . |
| 3,202,425 | | 8/1965 | Hennik . |
| 3,220,732 | * | 11/1965 | Pincus . |
| 3,499,650 | | 3/1970 | Lemelson . |

(List continued on next page.)

FOREIGN PATENT DOCUMENTS

1604881 * 12/1981 (GB) ..... 446/401

OTHER PUBLICATIONS

Sega "Lock On" toy description in IDS dated May 21, 1998 and photocopies of product carton and instructions.

Worlds of Wonder Laser Tag description in IDS dated May 21, 1998 and product photograph.

Panosh Laser Combat Description in IDS Dated May 21, 1998 and product photograph.

LJN/Entertech Photon Description in specification and photocopies of product carton.

Golub Laser Pro 9000 description in IDS dated May 21, 1998 and photocopies of product carton.

Hasbro Survivor Shot description in specification and product photograph.

*Primary Examiner*—Mark Sager
(74) *Attorney, Agent, or Firm*—Brown Raysman Millstein Felder & Steiner LLP

(57) ABSTRACT

The invention disclosed herein relates to a portable, player programmable, interactive toy for a shooting game played by radiating and appropriately detecting infrared light (or other radiated energy). Player sets of the toy include at least one IR emitter, at least one IR detector, and in the preferred embodiments, at least one audio or visual device. A keypad or other input device is provided for the entry of coded information to select from preprogrammed features and functions, including game modes, both prior to the start of a game and/or during a game. The interactivity includes at least two players interacting other than by detection of a hit, i.e., detection by one player of light shot by another player. The invention provides for information transfer between players to transfer or remotely activate features and functions or to remotely control another player's equipment. Programmed circuitry is provided which may be linked with other devices via an auxiliary connector or wirelessly for different purposes.

23 Claims, 7 Drawing Sheets

U.S. PATENT DOCUMENTS

| | | | | |
|---|---|---|---|---|
| 3,508,751 | | 4/1970 | Meyer et al. . | |
| 3,549,147 | | 12/1970 | Katter et al. . | |
| 3,795,400 | | 3/1974 | Glass et al. . | |
| 3,847,396 | * | 11/1974 | Ashford . | |
| 3,870,305 | | 3/1975 | Harclerode . | |
| 3,960,380 | | 6/1976 | Yokoi . | |
| 3,995,376 | | 12/1976 | Kimble et al. . | |
| 4,164,081 | | 8/1979 | Berke . | |
| 4,171,811 | | 10/1979 | Meyer et al. . | |
| 4,266,776 | | 5/1981 | Goldfarb . | |
| 4,267,606 | | 5/1981 | Stelter et al. . | |
| 4,352,665 | * | 10/1982 | Kimble et al. | 434/22 |
| 4,375,106 | | 2/1983 | Voll . | |
| 4,426,662 | | 1/1984 | Skerlos et al. . | |
| 4,533,144 | | 8/1985 | Juarez et al. . | |
| 4,586,715 | | 5/1986 | Scolari et al. . | |
| 4,629,427 | | 12/1986 | Gallagher . | |
| 4,718,593 | | 1/1988 | Rötzer . | |
| 4,754,133 | | 6/1988 | Bleich . | |
| 4,781,593 | | 11/1988 | Birge et al. . | |
| 4,802,675 | | 2/1989 | Wong et al. . | |
| 4,844,475 | | 7/1989 | Saffer et al. . | |
| 4,898,391 | | 2/1990 | Kelly et al. . | |
| 4,931,028 | | 6/1990 | Jaeger et al. . | |
| 4,938,483 | | 7/1990 | Yavetz . | |
| 5,029,872 | | 7/1991 | Sassak . | |
| 5,114,154 | | 5/1992 | Sellner . | |
| 5,127,657 | | 7/1992 | Ikezawa et al. . | |
| 5,127,658 | | 7/1992 | Openiano . | |
| 5,253,068 | | 10/1993 | Crook et al. . | |
| 5,322,296 | | 6/1994 | Weimerskirch . | |
| 5,375,847 | | 12/1994 | Fromm et al. . | |
| 5,382,026 | | 1/1995 | Harvard et al. . | |
| 5,401,025 | | 3/1995 | Smith, III et al. . | |
| 5,437,463 | | 8/1995 | Fromm . | |
| 5,552,917 | | 9/1996 | Darbee et al. . | |
| 5,577,962 | | 11/1996 | Kounoe et al. . | |
| 5,613,913 | | 3/1997 | Ikematsu et al. . | |
| 5,656,907 | | 8/1997 | Chainani et al. . | |
| 5,672,108 | | 9/1997 | Lam et al. . | |
| 5,741,185 | | 4/1998 | Kwan et al. . | |
| 5,785,592 | * | 7/1998 | Jacobson | 463/53 |
| 5,904,621 | * | 5/1999 | Small et al. | 463/52 |

* cited by examiner

PLAYER PROGRAMMABLE, INTERACTIVE TOY FOR A SHOOTING GAME

RELATED APPLICATIONS

The following U.S. patent applications, the disclosures of which are incorporated herein by reference, disclose subject matter related to the subject matter disclosed herein: application Ser. No.: 08/795,895, filed Feb. 5, 1997, titled "Interactive Light-Operated Toy Shooting Game, now U.S. Pat. No. 5,741,185"; and application Ser. No.: 08/871,248, filed Jun. 9, 1997, titled "Interactive Toy Shooting Game Having a Feelable Output, now U.S. Pat. No. 5,984,262". This application is a continuation-in-part of application Ser. No. 08/795,895.

BACKGROUND OF THE INVENTION

The invention disclosed herein relates to a portable, player programmable, interactive toy for a shooting game played by radiating energy, e.g., light, and detecting appropriately directed radiated energy. The programmability and interactivity include selection by a player or players, prior to the start of a game and/or during a game, of game functions and features including game modes, some or all of which are selected using preprogrammed codes entered by the player (s). The interactivity includes at least two players interacting other than by detection of a hit, i.e., detection by one player of light shot by another player.

In shooting games played by shooting some form of light and detecting when the shot light strikes a target, toys used in such games typically include a light emitter and a light detector. The light detector may be located with the target and detect light impinging on the target, or the light detector may be provided with the light emitter to detect light projected from a target. The target may be passive and simply reflect light impinging thereon, or active and incorporate a light emitter. Many remote control applications, including remote control of consumer electronics devices and toys, use transmitted and detected light. Some of the above toys and remote control devices pulse, modulate and/or code the light, which may be infrared ("IR") light.

The "Photon" toy of Entertech includes a gun having an IR emitter, a vest having a speaker and hit indicators and a helmet having an IR detector and electronic sound transmitters, all tethered together. This toy also has a computerized target with an adjustable skill level.

The "Survivor Shot" toy of Hasbro includes a gun with an IR emitter and a head unit with an IR detector and a vibrator which vibrates when the head unit registers a hit. The gun and head unit are tethered. The gun is adjustable to project light for long range, short range, single shot and multiple shot.

The "Laser Challenge" toy of Toymax Inc. of Plainview, N. Y. has been on sale in the United States more than one year before the filing of this application. application Ser. No. 08/795,895 generally describes the "Laser Challenge" toy.

The following U.S. Pat. Nos. disclose light toys or remote control devices: 2,119,005, 2,404,653, 2,957,693, 3,202,425, 3,499,650, 3,508,751, 3,549,147, 3,870,305, 3,960,380, 3,995,376, 4,164,081, 4,171,811, 4,266,776, 4,267,606, 4,375,106, 4,426,662, 4,533,144, 4,586,715, 4,629,427, 4,718,593, 4,754,133, 4,802,675, 4,844,475, 4,898,391, 4,931,028, 5,029,872, 5,253,068, 5,375,847, 5,401,025, 5,437,463, 5,552,917, 5,656,907, 5,672,108 and 5,577,962.

There is a need for a portable, toy for use in a shooting game which provides for more interactivity, both between and among players and between a player and his equipment, than such toys provided in the past.

OBJECTS AND SUMMARY OF THE INVENTION

It is an object of the invention disclosed herein to increase the play value of toys used in shooting games by making them more interactive, and/or by providing them with more player selectable features, and/or by making them player programmable, and/or by linking them to cooperate, for example to transfer information which affects game play between or among players.

It is another object of the invention to provide novel features for toys used in shooting games, particularly features that can be programmed or selected by a player at the start of or during a game.

It is another object of the invention to provide toys for a shooting game in which the players may interact in ways in addition to shooting at an opposing player and registering and processing hits.

It is another object of the invention to provide toys for a shooting game in which interactivity between players is increased by the ability of one player to interact with another player other than by firing and registering hits.

It is another object of the invention to enable players in a shooting game to transfer information from one player's equipment to another player's toy equipment, preferably through a wireless link.

A toy for a shooting game which incorporates the invention includes at least one radiation emitter which may be configured as some type of toy gun and at least one radiation detector which may be incorporated into the toy gun or into another toy item carried by a player, or even into a self-propelled or stationary toy item. Preferred embodiments of toys incorporating the invention provide audio and/or visual effects, including sound effects and speech phrases, associated with one or more of the following: selection and/or activation of game functions and features; radiation of energy; and detection of radiated energy ("hits") from another player's radiation emitter. In the preferred embodiment, the toy is comprises at least one light emitter, at least one light detector, and at least one audio device and/or visual device.

The at least one light emitter, light detector and audio and/or visual device may be combined into a player set which may comprise a single item of player toy equipment, or in two or more items coupled together. These items may be coupled by a wired or wireless link. "Wired link" is used herein in a broad sense and encompasses a link or coupling achieved through a tether (e.g., a cable which conducts electricity, light, sound, etc.). Similarly, "wireless link" is used herein in a broad sense and encompasses a link or coupling that does not require a tether, and includes links achieved through electromagnetic, optical (including IR), electrostatic, and acoustical (including ultrasonic) coupling.

A detector typically includes some type of sensor which senses wave energy and assists in detection thereof, although the terms detector and sensor are frequently used interchangeably. Typically a detector includes some type of circuitry which receives the output of a sensor.

An embodiment of a player set incorporating the invention disclosed herein is currently available from Toymax Inc. of Plainview, N.Y. under the mark "Laser Challenge Pro".

The invention disclosed herein provides a portable, programmed toy for a shooting game responsive to player input to select game features and functions from a relatively large number thereof prior to and/or during a shooting game. The invention provides for player input of coded information into a toy which allows a shooting game to include a large number of selectable features and functions, many of which are unique.

The invention also provides for information transfer between players (and other equipment) to transfer or remotely activate features and functions or to remotely control another player's equipment. The invention thus provides for remote control of many features and functions. In the preferred embodiment, such transfer is activated by player input of coded information, but may be preprogrammed to be activated by controls, time, sequences, or to respond to events, etc.

Play value is enhanced in two basic ways. The large number of features and functions which may be selected or used during a shooting game adds excitement because game play is less predictable. The ability to select features and functions prior to a game adds versatility so that over time the shooting game will not become repetitive and boring. Whether playing with only the same players time after time, or with one or more changing players, game features and functions may be selected to suit the particular players, play area, play time, etc., that are selected or used during any particular game. Further, the ability to transfer information adds another dimension to shooting games played with portable toys.

Player input may be achieved in any suitable way consistent with the large number of possible selections. Keypad entry is presently preferred, which may be wired or wirelessly coupled. Although keypad switches are typically momentary contact switches responsive to a pressing or push force, the switches may be a number of two position switches which together define a code. Also, player input may be by some form of machine reading, such as optical or magnetic scanning or wireless coupling, or by program loading, for example wirelessly or with removable media. Where player input involves entering codes assigned to the various features and functions, manual and mental dexterity is an asset and enhances play value. A player who has memorized all of the codes and can enter them quickly will have an advantage over a player who has difficulty remembering or entering the codes. The same generally applies where a player has to machine read or select media to load from a large selection thereof.

The ability to transfer information and to remotely control features and functions adds surprise to a shooting game and even more unpredictability. Since the transfer may be effected wirelessly, players can be unaware of the transfer and therefore taken by surprise by the immediate or delayed action caused by or reaction to the transferred information.

Among the many play and apparatus features and functions which are believed to be unique for a portable toy for a shooting game are the following, which may be implemented in a single or plural items, and with respect to play features and functions, may be selected or activated prior to the start of a game or during a game: the transfer of information from one player to another (other than one player's equipment registering a hit when it detects radiation from another player's equipment); data entry by keypad, machine reading or program loading; display of more than one parameter, with selection of a plurality of the parameters under control of the player with which the display is associated; assignment of players to teams and indication of team assignment discernible to opposing players; selection from more than two game modes and such selection using coded data entry; selection of more that two game features and functions, other than game mode, and such selection using coded data entry; selectable disabling of hit registration, referred to below as a "blast shield"; various reload game mode options including no reloads, limited reloads and unlimited reloads; various firing options, e.g., single shot, rapid single shots resembling semi-automatic fire while the trigger is squeezed (rapid fire), bursts of shots resembling automatic fire while the trigger is squeezed (super rapid fire) and continuous timed firing for a single trigger squeeze (autoblast); selection of audio and/or visual effects (e.g., lights out mode and temporary silent or mode); removal of a hit from a player's total; a false indication of a game ending audio or visual effect; where multiple detectors are employed, disabling one or more of them, e.g., temporarily; synchronized lighting on gun to simulate firing; the apparatus may comprise a player set made up of two or more parts, e.g., a gun, a front vest and a rear vest, and visual affects on the different parts are synchronized, and two or more of the parts may include a sensor or detector. Other unique features and functions are described below.

Using preselected codes, players may select game functions and features, including game modes, and during a game can select various game functions and features of the many available.

With respect to transferring information from one player to another, the information transfer may be between players on the same or opposing teams. Examples of transferrable information include transferring coded information to enable, disable, add to or subtract from a feature or function in the apparatus of another player. The transfer may involve a change in a feature or function of the transferring player. For example, where one player has a supply of a particular feature, the player may transfer one or more of the supply to another player. This results in decrementing the transferor player's supply as well as incrementing the transferee player's supply. The transfer may also involve uploading and downloading information. Many of the features and functions described above can be affected or implemented by the transfer of information described herein.

The toy may include connectors for connecting additional items to a player set and/or for connecting a cable to link player sets or a player set with other equipment such as a computer.

BRIEF DESCRIPTION OF THE DRAWINGS

The invention is illustrated in the figures of the accompanying drawings which are meant to be exemplary and not limiting, in which like numerals in the different figures refer to like or corresponding parts, and in which.

DESCRIPTION OF THE PREFERRED EMBODIMENTS

Figure 1:
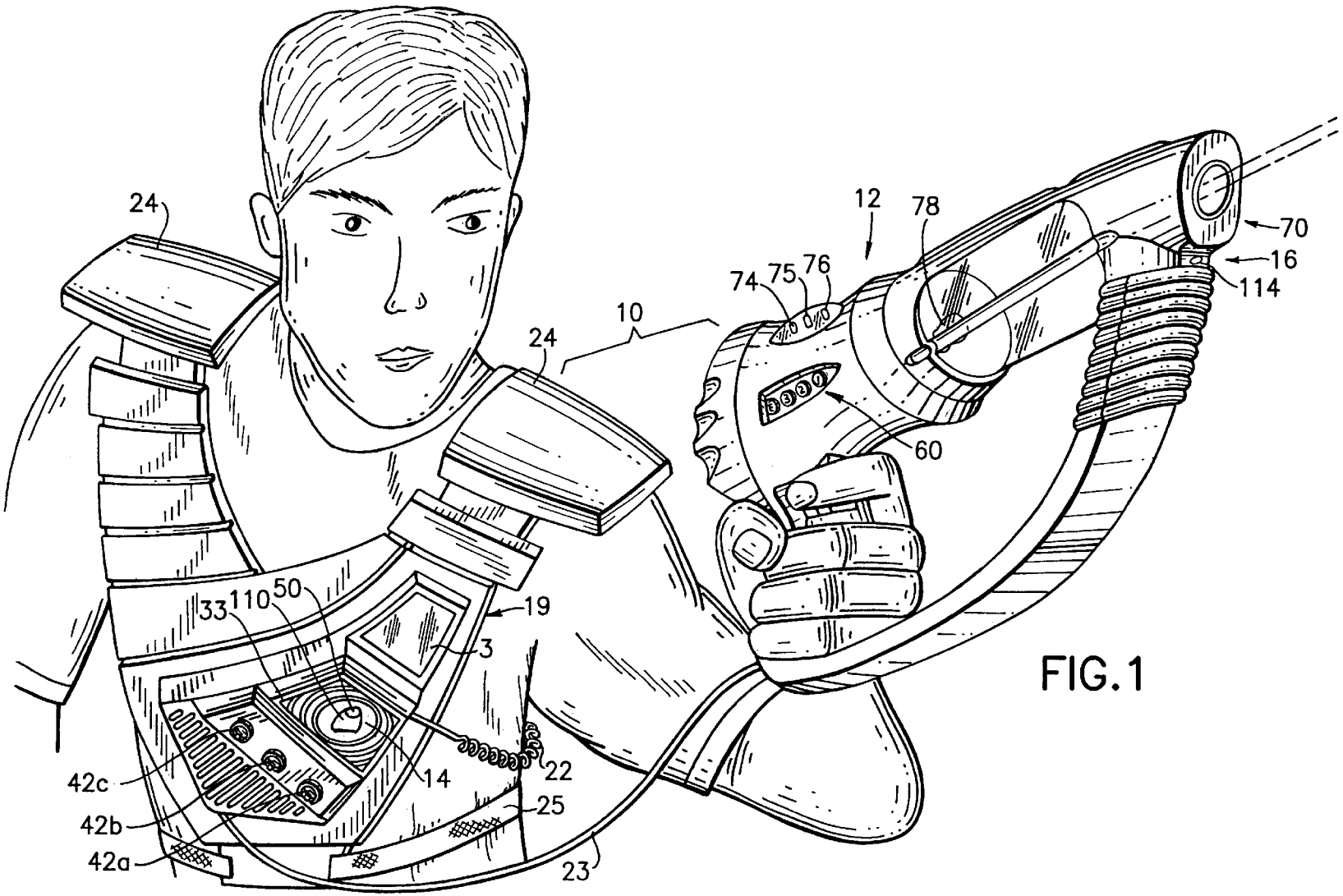
FIG. 1 is a perspective view of a player with a player set that incorporates the invention, including a toy light projector, or gun, and a vest having a front part and a back part, each a carrying a light sensor.

A shooting game played with a preferred embodiment of the inventive toy includes a plurality of inventive player sets 10 (FIGS. 1 and 2), each of which includes a toy light projector or light gun 12 configured as a futuristic "ray" gun, and at least one player-carried light detector which includes at least one sensor, e.g., 14. Alternatively, a game may be played with at least one player set 10 and at least one other compatible toy light projector gun and one other compatible toy light detector, for example as disclosed in application Ser. No. 08/795,895. In the preferred embodiment, the player set 10 includes three player-carried light sensors, a front player-carried sensor 14, and a back player-carried sensor 15, and a sensor 16 incorporated in the gun 12 carried by a player, all shown in FIGS. 1 and 2.

The front and back sensors 14 and 15 are carried by a harness or vest 18 (FIG. 2) comprising a front vest section 20 and a back vest section 20. The sensors 14–16 are linked by sets of conductors 22 and 23 to cooperate and share components, as discussed herein. While the preferred embodiment includes three player-carried light sensors, one, two or more than three player-carried sensors may be provided, and sensors and detectors may be provided that are not carried by a player.

Figure 4:
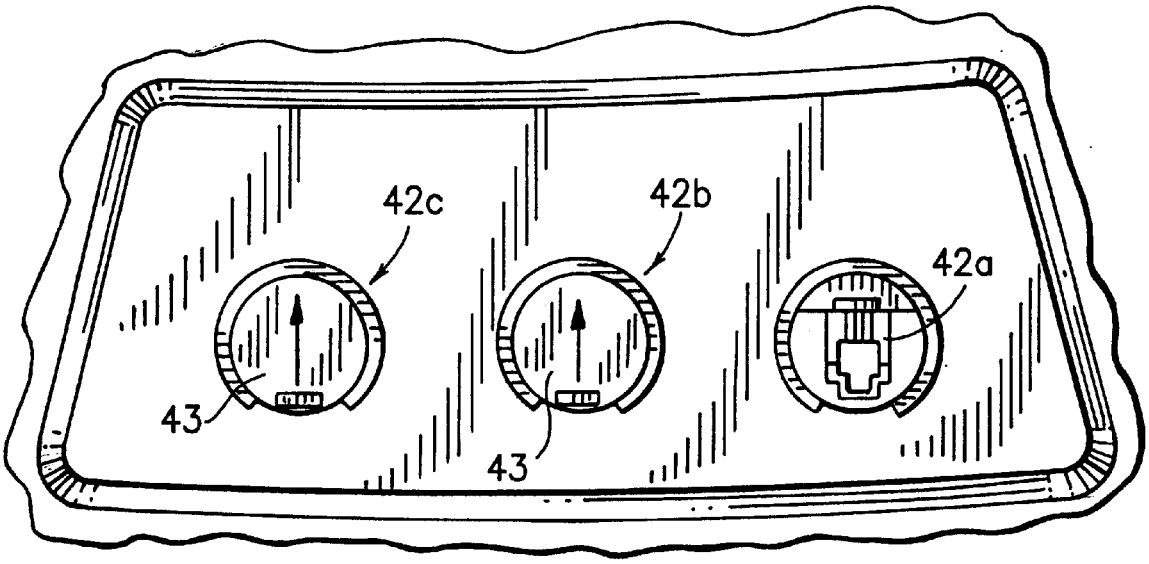
FIG. 4 is an enlarged plan view of auxiliary connectors on the front vest part depicted in FIGS. 1 and 2.

The front and back vest sections 19 and 20 (FIG. 2) of the player-worn vest 18 are adjustably fastened together by shoulder straps 24 and a back strap 25. Mounted to the vest front part 20 (in addition to the front sensor 14) are: a speaker 30 (FIG. 9) within a sound transmitting enclosure 31; three lamps 32 (Hit and "Blast Shield" indicators) covered by a light transmitting plate 33, an LED 36 ("Team" indicator) covered by a light transmitting plate 35, an On/Off switch 38, a vibrator device not shown, driven by motor 40 shown in FIG. 9, and three auxiliary connectors 42*a*, 42*b* and 42*c*, which in the preferred embodiment are phone jacks each covered by a respective sliding door 43 (FIG. 4).

The connectors 42*a*, 42*b* and 42*c* may be used for linking a player set to a computer, another player set, or accessories such as another sensor or gun. When a player set is coupled to a computer via a connector 42*a–c*, data concerning hits, statistics, etc. may be up loaded and down loaded. Also, the computer can program new features and functions into a player set. When two player sets are coupled via a connector 42*a–c*, features and functions may be transferred.

Mounted to the vest back part 20 (in addition to back sensor 15) are two lamps 45 (Hit and Blast Shield lamps) covered by a light transmitting plate 46.

The light sensors 14 and 15 in the front and back vest sections 29 and 20, respectively, are positioned in optical alignment with a light transmitting aperture 50 mounted to the respective light transmitting plate 33, 46 carried by the respective vest section. The respective lamps 32 and 45 are spaced about the periphery of the respective aperture 50.

Figure 6:
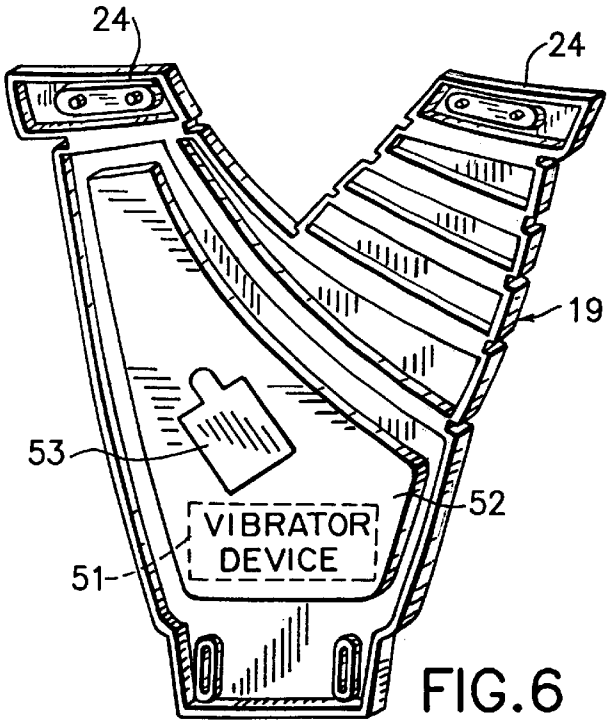
FIG. 6 is a plan view of the interior side of the front vest part depicted in FIGS. 1 and 2.

Referring to FIG. 6, a vibrator device 51 is mounted within the front vest section 19 so that the inside of a housing 52, which contacts the chest of a player, vibrates with sufficient magnitude to be easily felt by the player. A removable cover 53 provides access to a battery compartment in the front vest section 19. The inside of the back vest section 20 is similar to the inside of the front vest section 19. However, the back vest section 20 does not include a vibrator device and other components included in the front vest section 19, as discussed above.

Figure 5:
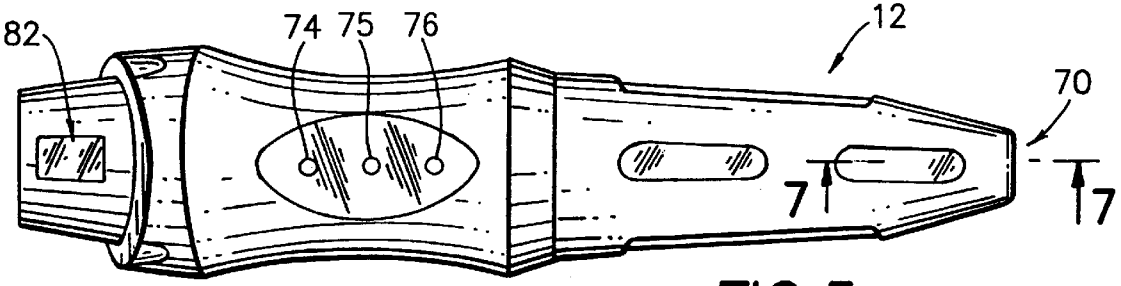
FIG. 5 is a top view of the gun depicted in FIGS. 1 and 2.

The toy light gun 12 includes, in addition to the light sensor 16, a housing 84 (FIG. 7, unreferenced in FIGS. 1, 2 and 5), a data input device or keypad 60 having keys or push buttons 62–65, a light emitter 70 (FIG. 7), light emitting diodes (LEDs) 74–76, a lamp 78, a trigger 80 and a digital display 82 (e.g., LCD, LED, etc.,) (FIG. 5), all carried by and visible from the exterior of the gun housing 84. Mounted within the gun housing 84 are a micro-switch 86 (FIG. 8) activated by the trigger 80, individual switches 88–91 (FIG. 8) of the keypad 60, and a terminal PC board (not shown) for making electrical connections between components carried by the gun housing 84 and components carried by the vest 18. The set of conductors 23 interconnects components carried by the gun housing 84 and the vest front part 20, and the set of conductors 22 interconnects components carried by the front and back vest sections 19 and 20 of the vest 26.

The gun housing 84 also carries an optical system 98 (FIGS. 7) which projects a beam of light emitted by the light emitter 70 from the toy gun 12 that can be detected by the front and back sensors 14 and 15 of the vest 18 of another player set 10, and by the sensor 16 of the gun of another player set 10. In the preferred embodiment, the gun light emitter 70 (FIG. 5) is an IR LED which emits IR light, and the light sensors 14–16 are IR light sensors which detect IR light. Also, in the preferred embodiment, IR light emitter 70 emits amplitude modulated IR light in short bursts or pulses, and the sensors of another receive such modulated IR light and provide it to a controller 75 (FIG. 8), described below.

Many modulation schemes are known in the art, and the specific type used is not critical. Any known or new suitable modulation scheme may be used. In the preferred embodiment, circuitry described below encodes light bursts by amplitude modulating them (e.g., by chopping) at a preselected frequency, and by providing different length bursts for firing and for transmitting information from one player set to another. It is practical to operate with up to about 28 different length bursts, which would allow 27 different features and functions to be transmitted or remotely controlled, plus the firing function. In the preferred embodiment, the preselected frequency is 37.9 KHz., and two different length bursts may be 1.0 ms and 1.5 ms, for example. Other suitable modulation frequencies and burst lengths may be used. Also, other modulation schemes would allow for more than 28 different codes so that even more features and functions can be transferred or remotely controlled.

The trigger 80 is spring loaded as described in copending application Ser. No. 08/795,895, and fires a single shot (pulse) of light with each trigger squeeze. Because the light emitter 70 in the toy light gun 12 is an LED, which, unlike some prior art "flash" light emitters does not require high energy to "fire", the light emitter 70 will rapidly fire in response to rapid trigger squeezes, or in rapid succession in one of the rapid fire modes described below.

Game Functions And Features

As discussed above, a player set 10 has a number of features and functions, including a plurality of operating modes, some of which may be selected prior to the start of or during a game. A specific embodiment is described in Tables 1–5 below. However, the invention disclosed herein encompasses additional features and functions supported by the disclosure herein or apparent therefrom, variations of the game modes, features and functions described herein and new modes, features and functions, and variations in combinations and permutations thereof.

A player set 10 operates with the general game functions defined in Table 1 below.

TABLE 1

| GENERAL GAME FUNCTIONS | |
|---|---|
| Function Name | Function Description |
| Blast (s) | A single or rapid successive bursts or shots of light projected from a player's gun upon pressing the trigger 80, or from an accessory light projector. |
| Hit | Detection by one player's player set of a light burst projected from another player's gun or from an accessory light projector. |
| Elimination | A player is eliminated from a game when the hits detected by that player's player set reach a given count, e.g., 5 or 10. |

The code elements listed in Table 2 below are assigned to the data input buttons 62–65 of the keypad 60, which are used to enter codes to program the game to operate in a desired game mode, or to activate a game feature or function.

TABLE 2

| KEYPAD CODES | |
|---|---|
| Button Number | Code Element |
| 62 | 1 |
| 63 | 2 |
| 64 | 3 |
| 65 | E |

Player selectable game features and functions include but are not limited to those listed in Tables 3 and 4, which are meant to be exemplary. Player sets 10 may be programmed to operate with variants of the features and functions listed in Tables 3 and 4, or with other features, or with less than all of the features and functions listed in Tables 3 and 4. Almost all of the features and functions are selected by entering a code using the keypad 60. Using three keys to enter codes, which are determined by the particular key or keys pressed and the sequence in which they are pressed, allows for the entry of up to 39 different codes. One, two or three keys may be pressed, followed by enter ("E"). Identification of the particular codes used to select or activate particular features and functions is not necessary for an understanding of the invention. Therefore, they are not listed in Tables 3 and 4. However, as an example, the code 1+1+1+E (pressing the 1 key three times followed by the enter key) may be assigned to the Reload function, and the code 1+2+3+E to the Display Reloads feature, etc.

TABLE 3

| PLAYER SELECTABLE GAME FUNCTIONS AND FEATURES | | |
|---|---|---|
| Entry by Keypad Code? | Feature or Function Name | Feature or Function Description |
| Yes | Reload | A player's gun is initially charged with a given number of Blasts set by the active (selected) Game Mode. A reload recharges the gun with the number of blasts set by the active Game Mode. |

TABLE 3-continued

| PLAYER SELECTABLE GAME FUNCTIONS AND FEATURES | | |
|---|---|---|
| Entry by Keypad Code? | Feature or Function Name | Feature or Function Description |
| Yes | Display Reloads | Causes the number of Reloads remaining in a game to be displayed on gun display 82. |
| Yes | Reset | Resets downwardly compatible targets not forming a part of a player set 10. (Has no effect on the operation of the gun 12 and IR sensors 14–16 of a player set 10.) |
| Yes | Rapid Fire | Multiple sequential Blasts while the gun trigger 80 is pressed. After reloading, the gun fires regular Blasts. |
| Yes | Super Rapid Fire | Faster multiple sequential Blasts than in Rapid Fire. (A Player can only activate Super Rapid Fire a given number of times per game, e.g., once.) |
| Yes | Max Blast | Causes a biast to be projected from a gun which when detected by another player's player set will register as three Hits. |
| Yes | Blast Shield | Disables a player set from registering a Hit for five seconds. |
| Yes | Temporary Silent Mode | Turns all audio off for a given time period |
| Yes | Blast Shield Transfer | Programs a gun when next fired to transfer information to add a Blast Shield to another player's player set. |
| Yes | Hit Remover | Removes a hit from the player set of the player entering the code. |
| Yes | Fake Loss | Detection of the next Hit by a player set will cause that player set to falsely sound the elimination sound effect, even though that player set is not eliminated |
| Yes | Eliminator | Programs a gun when next fired to transfer information to another player's player set to condition it to be eliminated upon detecting a given number of consecutive Hits within a given time period |
| Yes | Disabler | Programs a gun when next fired to transfer information to another player's player set to cause it to sound one or more sound effects, which disables that player set from firing while the sound effects are sounded. |
| Yes | Reverso | Programs a gun when next fired to transfer information to another player's player set to cause it to emit its next shot coded to remove a Hit from the player set that detects it. |
| Yes | Shot Transfer | Programs a gun when next fired to transfer information to add one or more shots to another player's player set. |
| Yes | Remote Reload | Programs a gun when next fired to transfer information to reload another player's player set. |
| Yes | Remote Hit Remover | Programs a gun when next fired to transfer information to add a Hit removal to another player's player set. |

TABLE 3-continued

| PLAYER SELECTABLE GAME FUNCTIONS AND FEATURES | | |
|---|---|---|
| Entry by Keypad Code? | Feature or Function Name | Feature or Function Description |
| Yes | Accessory Connector Activation | Enables a player set to receive or transmit via a given accessory connector 42a–42c, and conditions the player set to cooperate for a data transfer or any other function indicated by the entered code. |
| No (Trigger status when player set On/Off switch 38 is turned to On) | Team Selection | Multiple players may be arranged into opposing teams identified by the status of the team lamp 36 (continuous illumination for team A and strobed illumination for team B). Team selection is made when turning the toy player set on. Team A is selected for a player if the On/Off switch 38 of that player's player set 10 is turned on with the gun trigger 80 pressed, and Team B is selected if the On/Off switch 38 is turned on without the trigger pressed. |

A player set 10 is programmed to operate with the exemplary player selectable game modes listed in Table 4, but may have variants, others, or not all of those listed, as discussed above.

TABLE 4

| PLAYER SELECTABLE GAME MODES | | |
|---|---|---|
| Entry by Keypad Code? | Mode Name | Functions |
| Yes | Competition | 10 Hits for elimination<br>10 blasts per load<br>3 Reloads<br>3 Blast Shields<br>2 Max Blasts |
| Yes | Pro | 5 Hits for elimination<br>10 blasts per load<br>1 Reload<br>3 Blast Shields<br>2 Max Blasts |
| Yes | Timed | Same functions as Competition Mode, including 10 hits for elimination, except that the game is timed to end in 10 minutes; the surviving player (or team) with the fewest number of hits wins. |
| Yes | Silent | Same functions as Competition Mode, except that each player set 10 is silent except for Blank, Reload and Keypad sounds. |
| Yes | No Reload | 10 hits for elimination<br>100 blasts with no Reload<br>3 Blast Shields<br>2 Max Blasts |
| Yes | Lights Out | Same functions as Competition Mode, except that all lamps and LEDs are off with the exception of the Team lamp. |

A player set 10 is programmed to operate with the exemplary audio/video/sensory features listed in Tables 5A, 5B and 5C below, but may have others, or not all of those listed.

TABLE 5A

| AUDIO (SOUND EFFECTS) FEATURES |
|---|
| Sound effect for each Hit.<br>Warning sound effect on the Hit before Elimination.<br>Elimination sound effect.<br>Out of shots (empty) sound effect.<br>Reload sound effect.<br>Max Blast sound effect.<br>Blast Shield sound effect.<br>Keypad activation sound effect. |

TABLE 5B

| VISUAL FEATURES |
|---|
| LEDs 74–76 and lamp 78 on gun illuminate in advancing synchronism towards the gun nozzle with each shot.<br>Lamps 32 and 45 on vest front and back vest sections flash for the duration of a Blast Shield.<br>Team lamp 36 on the vest front section is either continuously illuminated or flashes for the duration of a game to indicate opposing teams.<br>Lamps 32 and 45 on the vest front and back sections flash after each Hit. |

TABLE 5C

| SENSORY FEATURES |
|---|
| Short vibration from inside of vest front section after each Hit.<br>Longer vibration from inside of front section upon warning of Elimination and upon Elimination.<br>Vibration from inside of vest front section for duration of a Blast Shield. |

Electronics

The electronic circuitry of the player set 10 is shown in FIGS. 8–11. In the preferred embodiment, the control and processing circuitry and the speaker are located in the vest front part, and the sensors, switches, display, lamp and LED indicators and the IR LED are located as described and illustrated. However, components may be suitably located, and suitably linked, other than as specifically described and illustrated.

The controller 75 (FIG. 8) controls overall operation and timing of the 10, LEDs 36, 74–76 and IR LED 70 illumination and operation of the display 82, and controller 95 (FIG. 9) controls the sound effects (speaker 30), bulb illumination (bulbs 32, 45 and 78) and vibrator action (motor 40). Controllers 75 and 95 are computers programmed to carry out the functions described herein, and preferably are integrated circuits. Any suitable circuit may be used for controllers 75 and 95. In the preferred embodiment, controller 75 is a 4-bit, series W741C250 microcontroller available from Winbond Electronics Corp., of Hsinchu, Taiwan, R.O.C., and controller 95 is an ADPCM voice synthesizer, series W52512, also available from WinBond Electronics Corp. The discussion below is based on use of the series W741C250 microcontroller and the series W52512 ADPCM voice synthesizer. Either or both of controllers 75 and 95 included structure and suitable programming to perform the computing functions described herein or necessary to support the features and functions described herein, including counting and timing.

Controller 75 receives signals from and provides signals to the gun 12 and the front and back vest sections 19 and 20.

Figure 9:
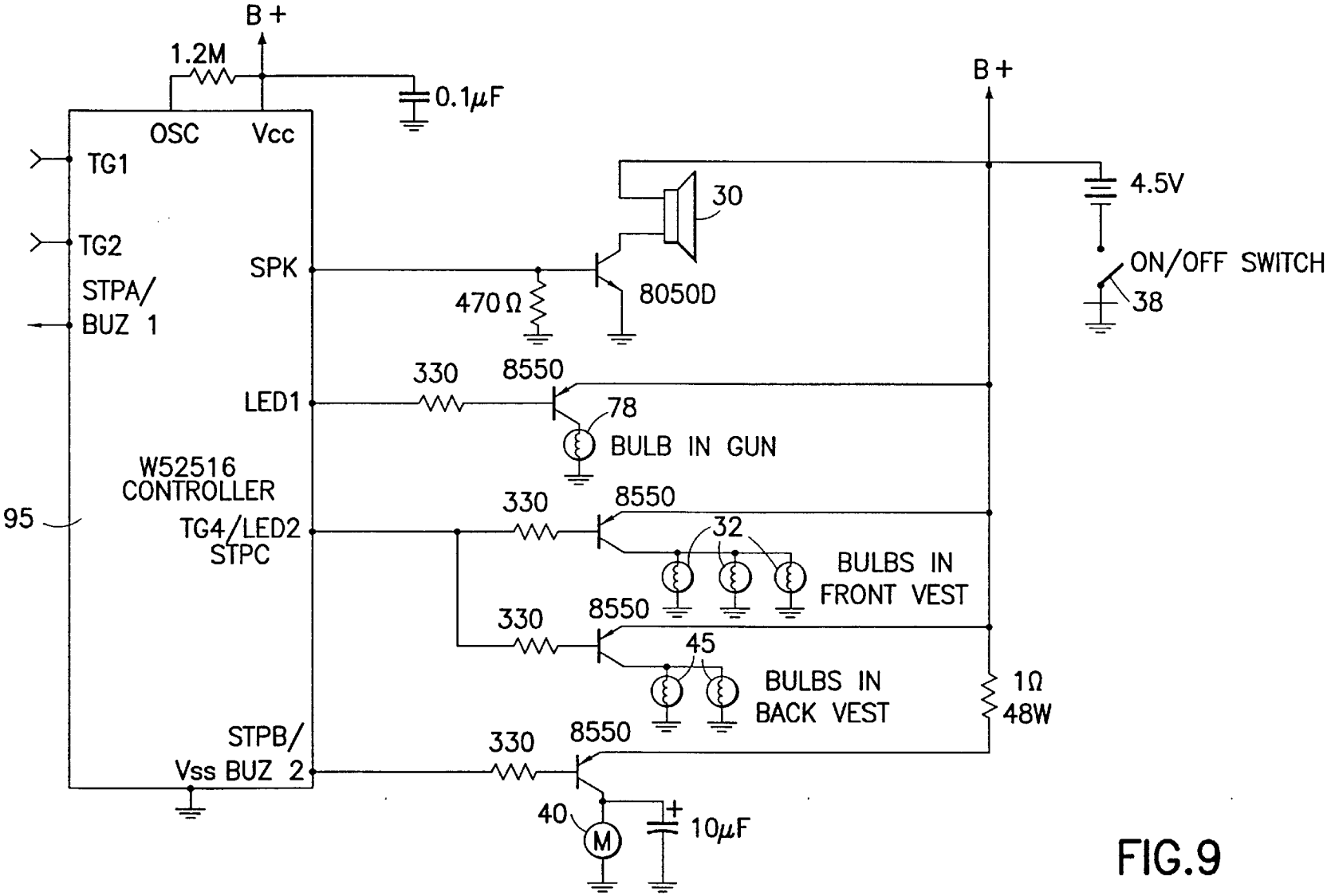
Figures 10, 11:
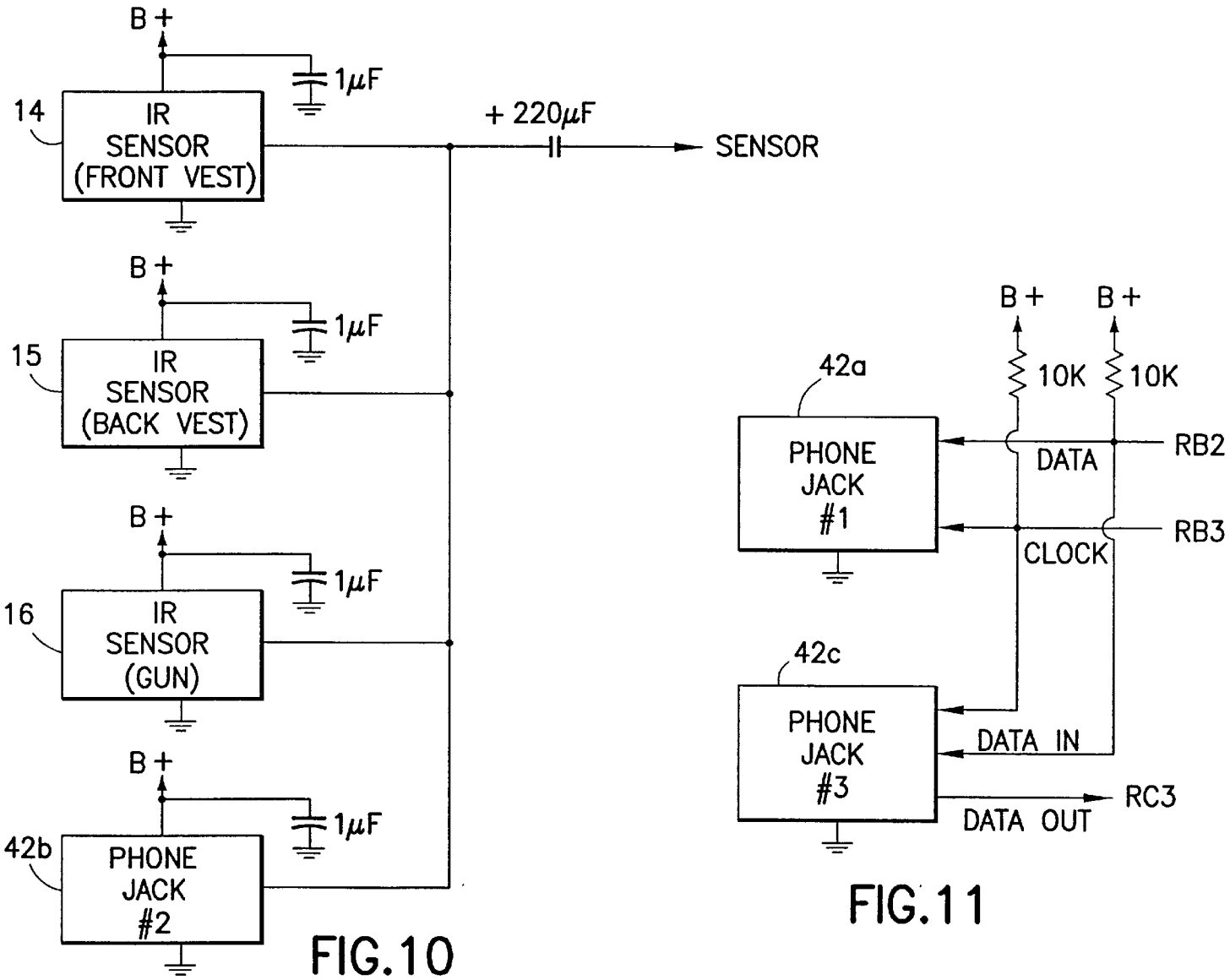

Specifically, the outputs of the light sensors 14–16 (FIG. 10) in the front vest section 19, the back vest section 20 and the gun 12, respectively, are coupled together in OR fashion and supplied to the "sensor" input (terminal RC0 of the RC input port) of the controller 75. The outputs of the keypad switches 88–91 are supplied to terminals RA0 through RA3 of the RA input/output port. The trigger switch 86 of the gun 12 is coupled to terminals RC1 and RC2 of the RC input port. Terminal RC3 of the RC input port is coupled to the phone jack 42*c* to receive data from a remote device. Signals are also coupled within the vest front part 19 between controller 75 and another controller 95 (FIG. 9).

Controller 95 includes a voice synthesizer and controls the speaker 30 (SPK output), the bulbs 23 (TG4/LED2/STPC output) and the vibrator motor 40 (STPB/BUZ2 output) in the vest front part 19, the bulb 78 (LED1 output) in the gun 12, and the bulbs 45 (TG4/LED2/STPC output) in the vest back part 20. Controller 75 receives on the RD0 terminal of its RD input port a busy signal output on the STPA/BUZ1 terminal of the controller 95. The busy signal informs the controller 75 that the controller 95 is outputting signals to the speaker, bulbs or the motor driving the vibrator device, and in response the controller 75 does not process switch and sensor inputs.

Controller 75 outputs TG1 and TG2 signals (on terminals RB0 and RB1 of its RB input/output port) to controller 95 which controller 95 which define a code that identifies which of the speaker 30, bulb(s) 78, 32 and 45 and the motor 40 are to be driven and the driving signal sequence therefor. Controller 95 decodes and the TG1 and TG2 signals and controls speaker 30, bulb(s) 78, 32 and 45 and the motor 40 in response thereto.

Controller 75 also outputs the following signals: data and a clock signal (on terminals RB2 and RB3 of the RB input/output port) to the phone jack 42*a* located in the vest front part 19 to provide data and a clock signal to a remote device; display signals (on outputs SEG0–SEG5) to the display 82 located on the gun 12; team identification signal (on output SEG8) to the Team LED 36 located on the vest front part 19; synchronized shot illumination signals (on outputs RE0–RE2 of the RE output port) to LEDs 74–76 in the gun 12; and an IR firing signal (on the modulatable MFP output) to the IR LED 70 in the gun 12. Illumination of the LEDs 74–76 and the lamp 78 in the gun 12 are synchronized to represent a laser being shot from the gun. In rapid succession, LED 74, then LED 75, then LED 76 and finally lamp 78 are illuminated in response to a trigger squeeze 80.

The controller 75 modulates the IR LED 70 as follows. The MFP output is controlled to turn transistor 71 on and modulate it at the preselected frequency for a preselected length of time corresponding to activation of the trigger switch 86 or a code entered by the keypad switches 88–91.

Programming

Programming for the controllers 75 and 95 to carry out the functions described herein can be constructed by one of skill in the art from the disclosure herein without undue experimentation.

Operation

A shooting game using the inventive toy is played as follows. The On/Off switch 38 of the player set 10 of each articipating player is switched on. If more than two players are playing and teams are to be formed, Team A members press the gun trigger 80 of their respective player set 10 at the same time that they turn the On/Off switch 38 of their respective player set 10 on, which causes the respective team LED 36 to be continuously illuminated, while Team B members simply turn the On/Off switch 38 of their respective player set 10 on without pressing the respective trigger 80, which causes the respective Team LED 36 to strobe.

After the On/Off switch 38 of a player set 10 is turned on, the speaker 30 in the associated vest 18 sounds the prompt message "enter code". One of the game mode codes described in Table 4 must then be entered using the keypad 60 for the player set 10 to be conditioned for use and for a game to proceed. If a code is not entered after the "enter code" prompt is sounded, the prompt will be repeated after a given delay. This can be repeated a given number of times. Unless a proper game mode code is timely entered, the player set 10 can not be operated, i.e., it will not shoot or detect shots.

All players coordinate to enter the same game code. Since in the disclosed embodiment the player sets 10 of different players are not networked, individual player sets can operate in different game modes and still interact. Also, since the player sets 10 are downwardly compatible with the light projectors and targets disclosed in copending application Ser. No. 08/795,895, games can be played where the equipment of one or more players does not operate in accordance with any of the game modes described in Table 4. Thus, variations of the game modes described in Table 4 may be fashioned by the players.

After programming a player set 10 to operate in a selected game mode before the start of a game, the game can proceed in accordance with the features and functions, including the audio/visual/sensory features described in the above tables. Squeezing the trigger 80 causes the electronics to supply a firing signal to the IR LED 70, and illumination signals to LEDs 74–76 and lamp 78 as described above. The electronics determines a hit upon the receipt of appropriate IR light by a sensor 14–16 as described above. One player set 10 can remotely activate or transfer a feature or function to another player set 10, as described above.

The player sets 10 provide several features which add to the play value of a shooting game. The toy light gun has a reload feature which requires that a player "reload" the gun after a given number of shots, i.e., light bursts, for example six. Appropriate sound effects are emitted when the gun runs out of shots and when it is reloaded.

Each player set 10 counts hits or detections of light from a another light gun 12, and in response to a given count of hits, eliminates a player set from further participation in a game, or ends the game. Game duration may also be timed, rather than based on elimination of the or all of the opposing players. As mentioned, the hit count may be reset remotely in targets of the type described in application Ser. No. 08/795,895 to reactivate the target by light guns described herein and in application Ser. No. 08/795,895. In the preferred embodiment, entering the reset code using the keypad 60 causes the gun 12 of the associated player set 10 to emit a burst of light coded differently from bursts of light emitted in response to pressing the trigger 80. Similarly, entering other information transfer codes using the keypad 60 causes the gun 12 of the associated player set 12 to emit a correspondingly coded burst of light.

Further operating details will be apparent from the above tables and other disclosure.

Optics

Figure 7:
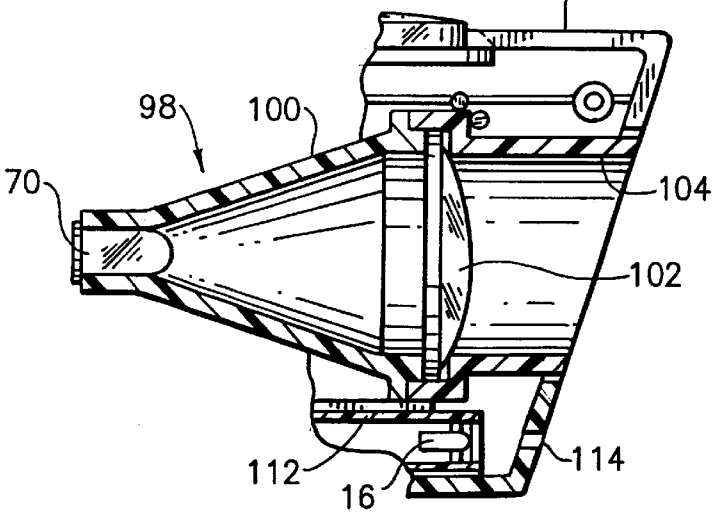
FIG. 7 is a section view of the nozzle end of the gun depicted in FIGS. 1 and 2 taken along line 7—7 in FIG. 5.
Figure 8:
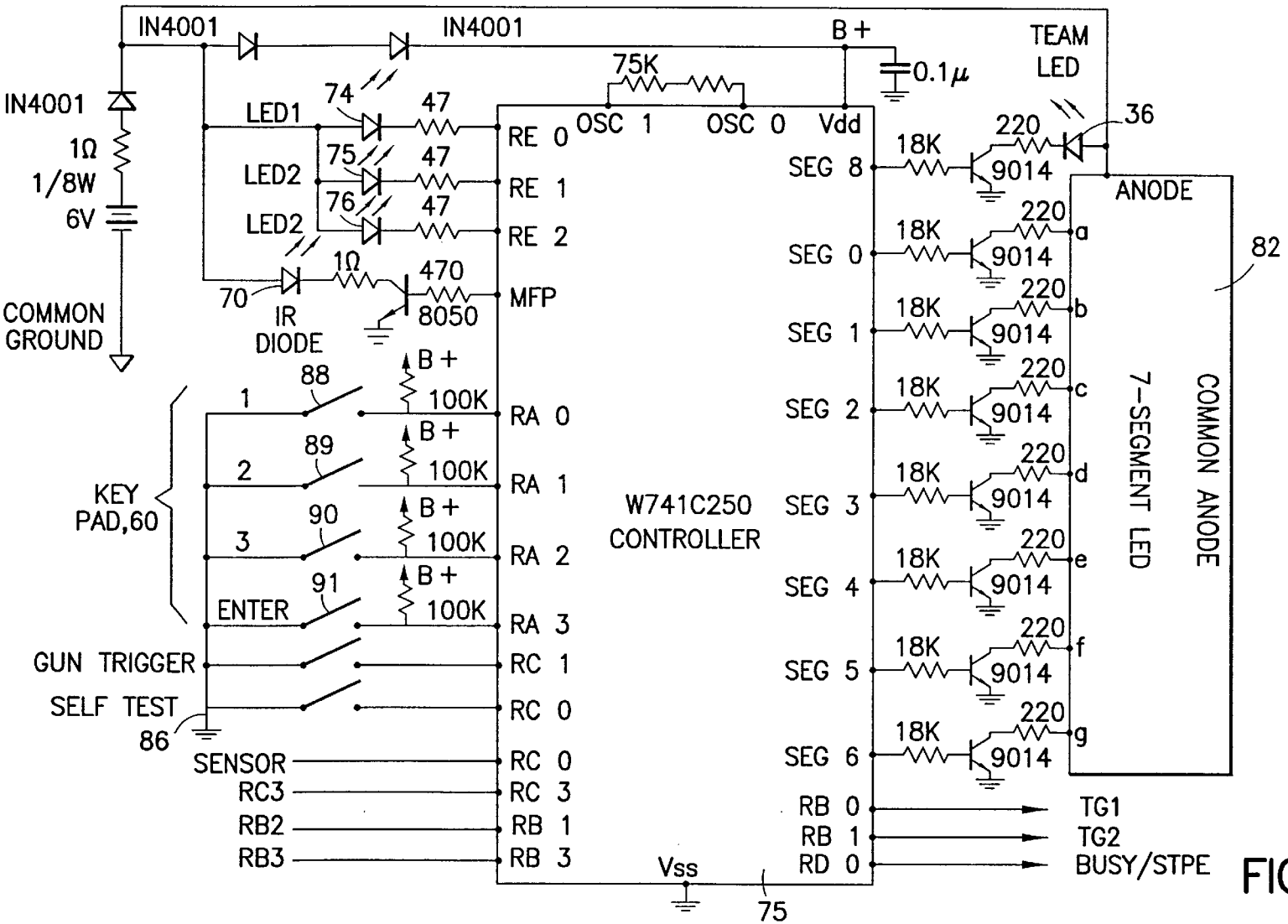
FIGS. 8–11 are schematic diagrams of the circuitry in the depicted in FIGS. 1 and 2.

The game is operable under varying light conditions, from darkness, to dim lighting to bright daylight, and for distances up to 300 feet. Referring to FIG. 7, the optical system 98 includes a conical section 100, a lens 102 and a cylindrical section 104 having a circular aperture 106. The lens 102 has the following characteristics and dimensions: flat on the side facing the IR LED 70 and curved on the opposite side with a radius of curvature of 1.160 inch; a diameter of 0.9 inch, a clear aperture diameter of 0.8 inch and a maximum thickness of 0.150 inch; made of acrylic with surface quality of 20 rings of power and 8 rings of irregularity, and 80/50 scratch and dig. The lens 102 is positioned 1.540 inch from the IR LED 70.

Figure 2:
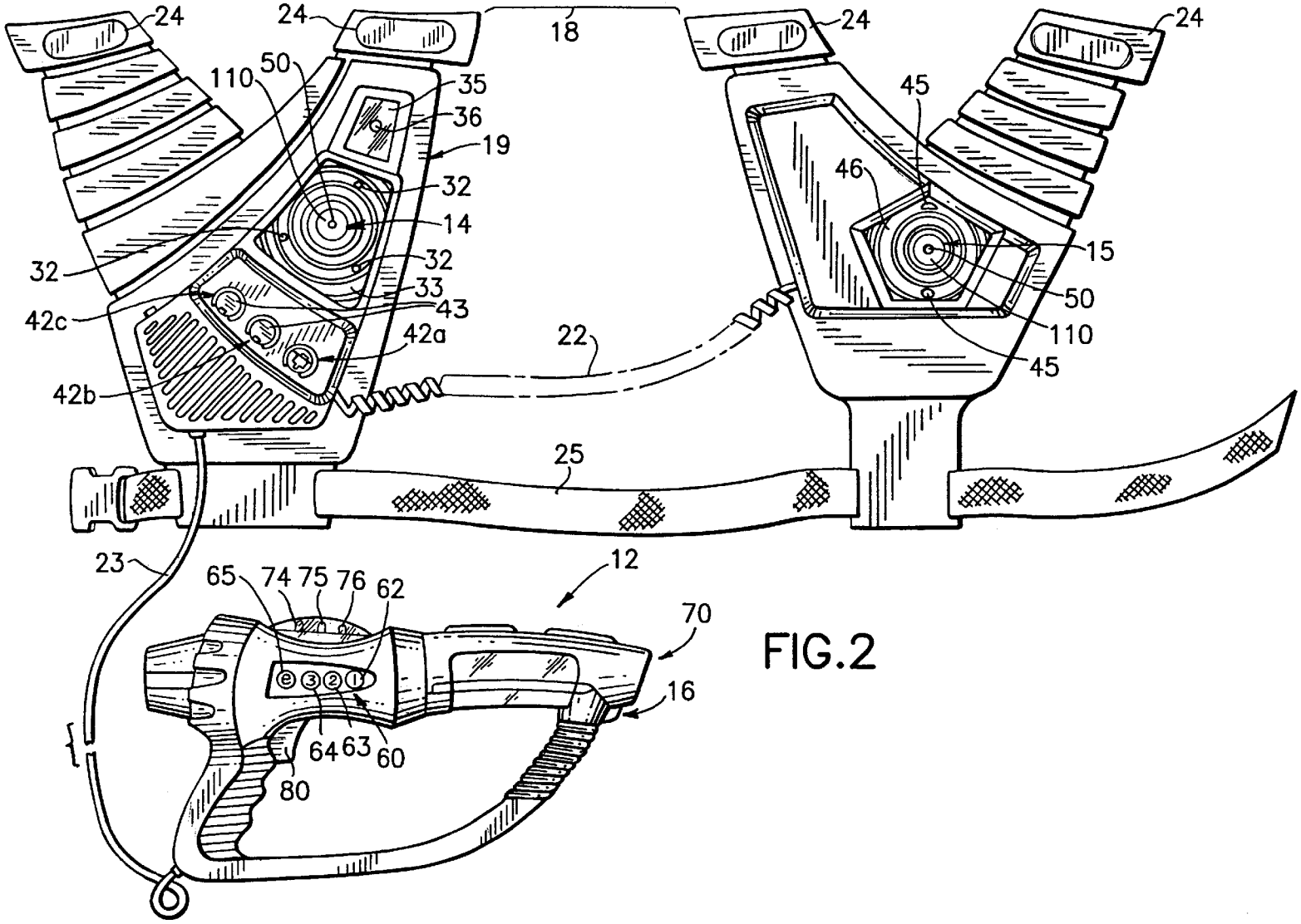
FIG. 2 is a plan view of the depicted in FIG. 1.
Figure 3:
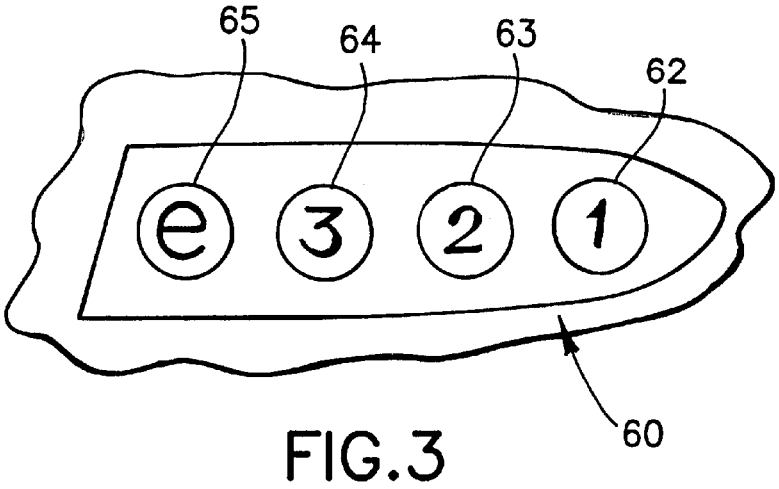
FIG. 3 is an enlarged plan view of a keypad of the gun depicted in FIGS. 1 and 2.

The sensors 14–16 are mounted to directionally receive IR light projected at them. In the vest front and back parts 19 and 20, the sensors 14 and 15 are mounted in a bulbous or hemispherical projection 110 in alignment with a small aperture 50 (FIGS. 1–2). In the gun 12, the sensor 16 is mounted in a holder 112 in optical alignment with an aperture 114, as shown in FIG. 7.

While the invention has been described and illustrated in connection with preferred embodiments, many variations and modifications, as will be evident to those skilled in the art, may be made without departing from the spirit and scope of the invention. For example, as discussed above, information transferred from one player to another may be used to activate many features and functions, and variations thereof. Also, features and functions other than those described herein, and variations of the features and functions described herein are possible. Further, the different components of a player set may be wirelessly coupled, and a player set may comprise different components and variations of the components disclosed herein. Still further, information may be transferred from one player to another wirelessly or by a wired connection. In the preferred embodiments, certain functions are initiated or controlled by manual activation of a control such as a switch or from detection of transferred information (remote activation) which provide an input signal to circuitry which controls or provides the feature or function. However, input signals to initiate or control a feature or function may be provided in other ways. The invention as set forth in the appended claims is thus not limited to the precise details of construction set forth above as such variations and modifications are intended to be included within the spirit and scope of the invention as defined in the appended claims.

What is claimed is:

1. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said energy sensor has been emitted by another energy projector;

an input device coupled to said at least one circuit;

said at least one circuit being responsive to coded information provided by said input device to cause said toy to change its status or operation;

wherein said at least one circuit in response to a given code in coded information provided by said input device conditions said toy to operate in a game ending mode defined by the number of determinations of hits made by said at least one circuit.

2. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said energy sensor has been emitted by another energy projector;

an input device coupled to said at least one circuit;

said at least one circuit being responsive to coded information provided by said input device to cause said toy to change its status or operation;

wherein said at least one circuit includes means for measuring time, and in response to a given code provided by said input device conditions said toy to operate in a game ending mode defined by the expiration of a given time period.

3. The toy of claim 2 comprising a display device coupled to said at least one circuit, said at least one circuit causing said display device to display a value relating to time remaining to the end of said period.

4. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said energy sensor has been emitted by another energy projector;

an input device coupled to said at least one circuit;

said at least one circuit being responsive to coded information provided by said input device to cause said toy to change its status or operation; and at least one sound generating device coupled to said at least one circuit, said toy operating in a sound active mode in which said at least one circuit causes said sound generating device to produce one or more sounds in response to one or more given conditions and in a sound inactive mode in which said sound producing device does not produce said at least one of said sounds in response to at least one of said given conditions, wherein said at least one circuit in response to a given code in coded information provided by said input device causes said toy to change from a sound active or inactive mode to a sound inactive or active mode, respectively.

5. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said energy sensor has been emitted by another energy projector;

an input device coupled to said at least one circuit;

said at least one circuit being responsive to coded information provided by said input device to cause said toy to change its status or operation; and one or more visual indicators coupled to said at least one circuit, said toy operating in a visual indicator active mode in which said at least one circuit causes at least one of said visual indicators to provide a visual indication in response to a given game condition and in a visual indicator inactive mode in which said at least one visual indicator device does not provide said visual indication in response to said given game condition, wherein said at least one circuit in response to a given code in coded information provided by said input device causes said toy to change from a visual indicator active or inactive mode to a visual indicator inactive or active mode, respectively.

6. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said sensor has been emitted by another energy projector;

an input device coupled to said at least one circuit;

said at least one circuit being responsive to coded information provided by said input device to cause said toy to change status or operation;

a display device coupled to said at least one circuit, said at least one circuit being responsive to a code in coded information provided by said input device to cause said display to display selected information.

7. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said energy sensor has been emitted by another energy projector;

an input device coupled to said at least one circuit;

said at least one circuit being responsive to coded information provided by said input device to cause said toy to change its status or operation;

wherein said at least one circuit in response to a code in coded information provided by said input device causes said projector to project wave energy coded with information to be transferred to a toy of another player.

8. The toy of claim 1,2,3,4,5,6,7 wherein said toy is operable in a plurality of selectable modes and said at least one circuit is responsive to codes in coded information provided by said input device to cause said toy to operate in a mode corresponding to a code in coded information provided, by said input device.

9. The toy of claim 1,2,3,4,5,6,7 wherein said toy has a plurality of selectable features and/or functions, and said at least one circuit is responsive to codes in coded information provided by said input device to cause said toy to operate with or without a feature or function corresponding to a code in coded information provided by said input device.

10. The toy of claim 1,2,3,4,5,6,7 wherein said wave energy source is a light source and said wave energy sensor is a light sensor.

11. The toy of claim 1,2,3,4,5,6,7 wherein said wave energy source is an infrared (IR) light source and said wave energy sensor is an IR light sensor.

12. The toy of claim 1,2,3,4,5,6,7 wherein said at least one circuit includes means for disabling said energy projector from projecting wave energy after a given number of energy projections, and in response to a given code in coded information provided by said input device enables said energy projector to project energy therefrom in response to said input signal.

13. The toy of claim 1,2,3,4,5,6,7 wherein said at least one circuit controls energization of said energy projector, in response to a code in coded information provided by said input device, to project energy in a single burst or in multiple bursts in response to said input signal.

14. The toy of claim 1,2,3,4,5,6,7 wherein said at least one circuit in response to a code in information provided by said input device disables determination of hits by said toy for a given time period.

15. The toy of claim 1,2,3,4,5,6,7 wherein said at least one circuit in response to a code in coded information provided by said input device encodes the energy projected by said energy projector to represent multiple hits when another circuit of a toy of another player makes a determination that a hit has occurred.

16. The toy of claim 1,2,3,4,5,6,7 wherein said at least one circuit causes said wave energy projector to project wave energy coded with a first code in response to said input signal, and wherein said at least one circuit is responsive to a code in coded information provided by said input device to cause said wave energy projector to project wave energy coded with a second code instead of said first code.

17. The toy of claim 1,2,3,4,5,6,7 comprising a visual indicator, said at least one circuit controlling said visual indicator in a game start condition to provide and maintain a first indication for the duration of a game.

18. A toy for a shooting game comprising:

a wave energy projector comprising a wave energy source which projects wave energy from said projector in response to an input signal;

a wave energy sensor providing signals responsive to wave energy received by said sensor emitted by another energy projector having another energy source compatible with said energy source;

at least one circuit coupled to said energy source and said sensor which controls operation of said toy, including operation of said energy projector to project wave energy therefrom, processing said signals provided by said energy sensor and making a determination that a hit has occurred when energy received by said energy sensor has been emitted by another energy projector;

an input device coupled to said at least one circuit;

said at least one circuit being responsive to coded information provided by said input device to cause said toy to change its status or operation;

wherein said at least one circuit includes means for disabling said energy projector from projecting wave energy after a given number of energy projections, and in response to a first code in coded information provided by said input device enables said energy projector to project energy therefrom in response to further input signals, and wherein said at least one circuit is responsive to a second code in coded information provided by said input device to cause said toy to operate in a mode in which said circuit does not respond to said first code.

19. A toy for a shooting game comprising:

at least one of a wave energy projector comprising a wave energy source which projects wave energy from said projector in response to an input signal, and a wave energy sensor providing signals responsive to wave energy received by said sensor emitted by another energy projector having another energy source compatible with said energy source;

at least one circuit coupled to said at least one of said energy source, if present, to and said projector, if present, which controls operation of said toy, including selectively providing said input signal to said projector, if present, and processing signals provided by said sensor, if present, to determine when said sensor receives wave energy from said another energy source;

an input device coupled to said at least one circuit;

said at least one circuit being responsive to given coded information provided by said input device to condition said toy for use in a game, and in the absence said given coded information prevent operation of at least one feature or function of said toy;

wherein said at least one circuit in the absence of said given coded information prevents said input signal from being supplied to said projector, if present, and does not determine when said sensor, if present, receives wave energy from said another energy source, thereby effectively precluding said toy from being used in a shooting game until said given coded information is input.

20. A toy for a shooting game comprising:

a first wave energy projector comprising a first wave energy source which projects wave energy from said projector having first coded information in response to an input signal and second coded information in response to an input signal different from said input signal;

a wave energy sensor providing signals responsive to wave energy received by said sensor emitted by said first wave energy projector;

a second wave energy projector which projects wave energy therefrom compatible with the wave energy projected by said first projector in response to an input signal supplied thereto;

at least one circuit coupled to said sensor and said second projector which controls operation of said second projector to project wave energy therefrom, said at least one circuit processing said signals provided by said energy sensor and controlling operation of at least one feature or function of said second projector in response to said signals provided by said sensor corresponding to coded information in the wave energy from said first projector;

wherein said circuit disables said second projector from projecting energy therefrom in response to said input signal supplied to said second projector after a given number of energy projections from said second projector, and wherein responsive to said signals provided by said sensor, enables said second projector to project energy therefrom in response to another said input signal supplied to said second projector.

21. A toy for a shooting game comprising:

a first wave energy projector comprising a first wave energy source which projects wave energy from said projector having first coded information in response to an input signal and second coded information in response to an input signal different from said input signal;

a wave energy sensor providing signals responsive to wave energy received by said sensor emitted by said first projector;

a second wave energy projector which projects wave energy therefrom compatible with the wave energy projected by said first projector in response to an input signal supplied thereto;

at least one output device;

at least one circuit coupled to said sensor, said second projector and said at least one output device, said at least one circuit controlling operation of said second projector to project wave energy therefrom, said at least one circuit processing said signals provided by said sensor and controlling operation of at least one feature or function of said at least one output device in response to said signals provided by said sensor corresponding to both the first and the second coded information in the wave energy from said first projector;

wherein said circuit disables said second projector from projecting energy therefrom in response to said input signal supplied to said second projector after a given number of energy projections from said second projector, and wherein responsive to said signals provided by said sensor, enables said second projector to project energy therefrom in response to another said input signal supplied to said second projector; and wherein said at least one circuit also controls operation of at least one feature or function of both said at least one output device and said second projector.

22. The toy of claim 20 or 21 wherein said circuit is operative, responsive to said signals provided by said sensor, to prevent said second projector from projecting wave energy therefrom in response to said input signal supplied to said second projector.

23. The toy of claim 20 or 21 wherein said at least one circuit controls said second energy projector to project energy coded to represent multiple hits responsive to said input signal supplied to said second projector and to said signals provided by said sensor.

* * * * *